United States Patent [19]

Sanders

[11] 3,943,875

[45] Mar. 16, 1976

[54] METHOD AND APPARATUS FOR LAUNCHING AND RECOVERING SUBMERSIBLES

[75] Inventor: Raymond J. Sanders, Vancouver, Canada

[73] Assignee: British Columbia Research Council, Vancouver, Canada

[22] Filed: May 13, 1974

[21] Appl. No.: 469,556

Related U.S. Application Data

[63] Continuation of Ser. No. 338,085, March 5, 1973, abandoned.

[52] U.S. Cl. .... 114/235 B; 114/43.5 VC; 214/15 R

[51] Int. Cl.[2] ..... B63B 21/56

[58] Field of Search ..... 114/235 R, 235 A, 235 B, 114/16 R, 16 A, 44, 43.5, 50, 51; 244/135 A; 214/15 R; 24/211 N

[56] References Cited

UNITED STATES PATENTS

| | | | |
|---|---|---|---|
| 2,377,442 | 6/1945 | Osterhoudt | 114/16 R |
| 3,061,246 | 10/1962 | Kirby | 244/135 A |
| 3,430,305 | 3/1969 | Geffner | 24/211 N |
| 3,448,712 | 6/1969 | Lehmann et al. | 114/44 |
| 3,507,241 | 4/1970 | Southerland, Jr. et al. | 114/43.5 |
| 3,536,023 | 10/1970 | Toher et al. | 114/43.5 |
| 3,631,829 | 1/1972 | Kamph | 114/43.5 |
| 3,667,566 | 6/1972 | Hopkins | 24/211 N |
| 3,722,452 | 3/1973 | Wynn, Jr. | 114/235 R |
| 3,754,581 | 8/1973 | Taggart | 114/235 R |
| 3,757,722 | 9/1973 | Seiple | 114/16 R |

*Primary Examiner*—Trygve M. Blix
*Assistant Examiner*—Edward R. Kazenske
*Attorney, Agent, or Firm*—Fetherstonhaugh & Company

[57] ABSTRACT

A method of launching and recovering self-propelled submersibles by using a drogue below the surface of the water where comparatively stable conditions exist. A probe on the submersible is unlatched from or latched to the drogue during relative movement therebetween when it is desired to release or recover the submersible. The apparatus includes a suitable drogue, a probe connected to the submersible, and releasable latching device in the drogue and on the probe.

19 Claims, 9 Drawing Figures

METHOD AND APPARATUS FOR LAUNCHING AND RECOVERING SUBMERSIBLES

Figure 1:
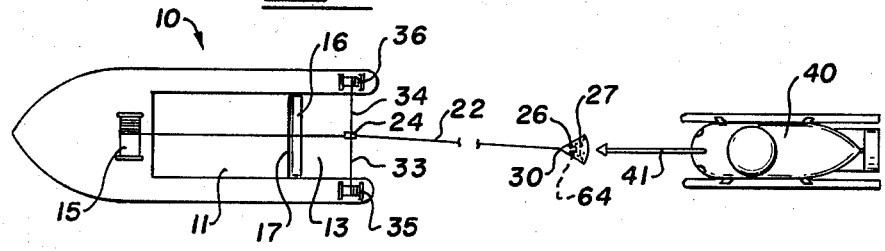

This is a continuation of application Ser. No. 338,085, filed Mar. 5, 1973, now abandoned.

This invention relates to method and apparatus for launching and recovering self-propelled submersibles.

The use of small self-propelled submersibles by industry and the military for exploration of the sea, the sea floor, and the inspection and servicing of under-sea equipment and installations is increasing steadily throughout the world. The ability to launch and recover these vessels is limited by the state of the sea at the time, and this controls their utilization.

One of the limiting factors to the use of these submersibles is the difficulty in launching and retrieving them in rough seas. Numerous different harnesses and sling arrangements have been devised for recovering the submersibles, but these do not overcome the problem of recovery in rough seas. As a result, these vessels can be launched and recovered only when the sea conditions are relatively mild. An elaborate elevator device has been devised for recovering submarines, but this is very expensive, relatively complicated, and not too practical for everyday use with relatively small submersibles.

The method and apparatus according to the present invention make it possible to launch and recover submersibles in comparatively rough weather, thus greatly increasing the periods during which these submersibles can be used. It is known that not far below the surface of the sea comparatively stable conditions exist no matter how rough the sea state is at the surface. It is proposed that the main part of the launching and recovery be accomplished below the surface of the sea where the comparatively stable conditions exist. The main difficulty is in getting a line on the submersible, and this is done in the area of stable sea conditions. Thus, the present invention is mainly concerned with recovering the submersibles, although the reverse technique is used to launch them.

The method of the present invention teaches launching and recovering a submersible in water by means of a probe element releasably latchable with a drogue element, one of said elements being connected to a cable and the other of said elements being connected to the submersible, comprising moving the drogue element relative to the probe element or vice versa through the water at a level below the surface thereof where comparatively stable conditions exist at the moment of latching together or unlatching the probe element and the drogue element.

The method according to the present invention of recovering a small self-propelled submersible from the water in which the submersible is operating by means of a drogue element and a probe element, one of said elements being connected to cable means and the other of said elements being connected to the submersible, and which comprises towing one of said elements by the cable means through the water at a level below the surface thereof where comparatively stable conditions exist, said drogue element and said probe element having co-operative latching components thereon, unlatching said components to free the submersible from the cable means or latching said components together to secure the submersible to the cable means.

In carrying out a preferred form of this method a drogue is towed by a recovery vessel through a cable connected to the drogue. The drogue is designed to have trimmable negative buoyancy, which is set in any suitable manner, such as by means of flotation and ballast tanks on the drogue, and the towing cable will be of material selected for slight negative buoyancy as well as tensile strength. These features will ensure that the drogue will take up its correct attitude when towed at the submersible recovery speed, with the length of the cable controlled to maintain the drogue at a desired depth below the sea surface. It should be noted that submersible recovery speed will be considerably slower than the normal cruising speed of the submersible. Due to the catenary taken up by a cable of more than a minumum length, the drogue tows in a relatively stable condition virtually uneffected by surface sea conditions. The drogue is shaped to ensure stable towing characteristics through the water with minumum turbulence and drag. If desired, the drogue may have suitable vanes projecting therefrom for this purpose.

It is preferable to tow the cable by a vessel having a ramp extending down into the water and along which the cable extends. With this arrangement, when the cable is drawn or winched in, the submersible is drawn to the ramp and up the latter. It is preferable to guide the cable so as to keep it moving up the ramp in a predetermined line while keeping it taut.

The method of launching the submersible according to this invention comprises paying out the cable from the vessel with the probe of the submersible latched to the drogue until the submersible reaches the desired depth where stable conditions exist beneath the surface of the water, and then releasing the probe from the drogue to free the submersible.

Apparatus according to the present invention comprises a drogue having an attaching end and a receiving end, a cable connected to said attaching end to extend from a recovery vessel, a probe connected to the submersible, and a releasable latch arrangement having cooperating parts within the drogue and on the probe whereby insertion of the probe into the drogue releasably connects the submersible to said drogue. The apparatus may be such that the elements thereof are reversed, that is, the drogue may have a probe projecting therefrom, and a receiver for the probe may be attached to the submersible.

Figure 2:
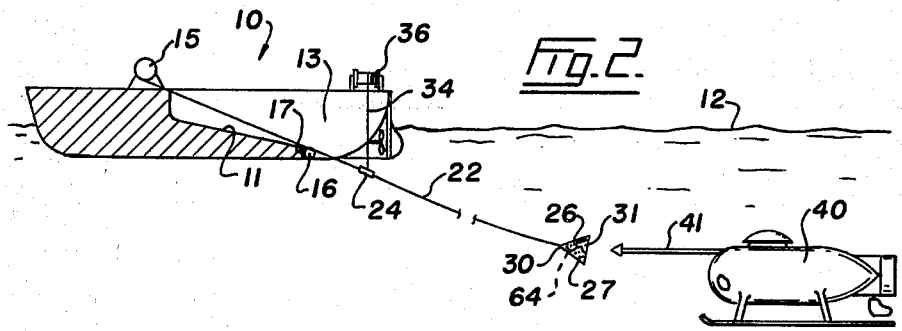
Figure 3:
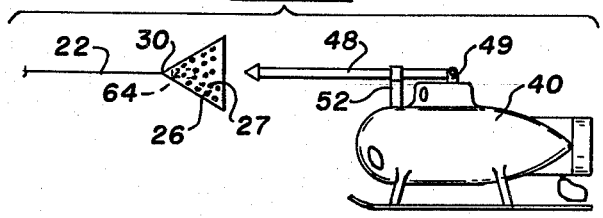
Figure 4:
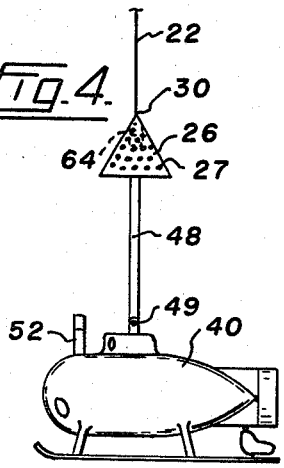
Figure 5:
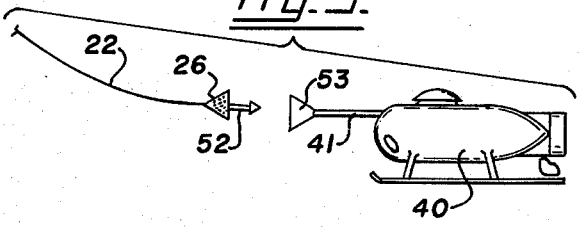
Figure 7:
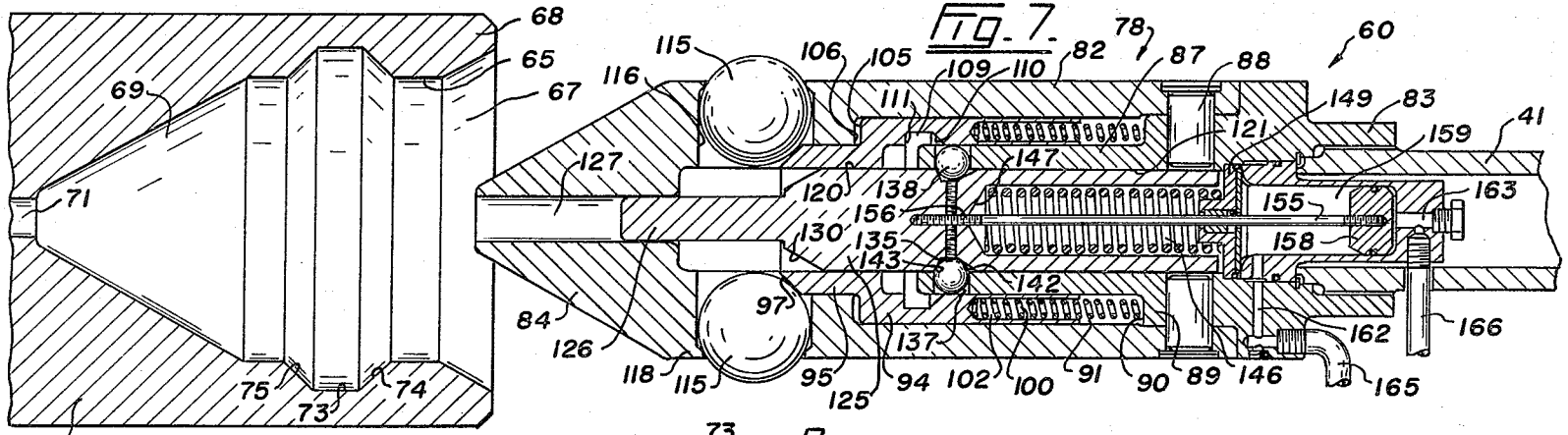
Figure 8:
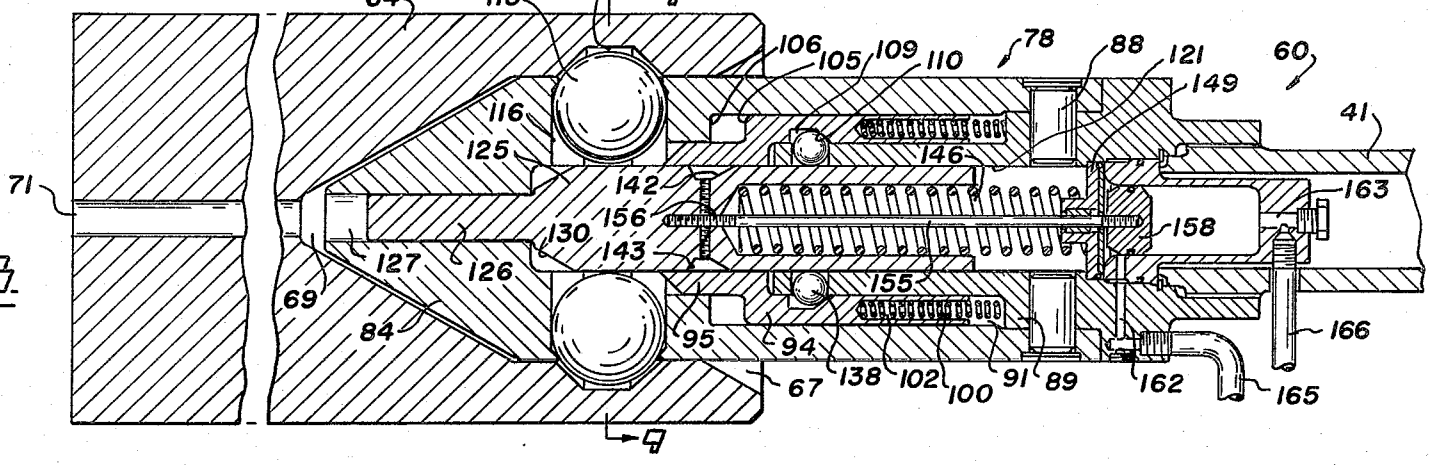
Figure 6:
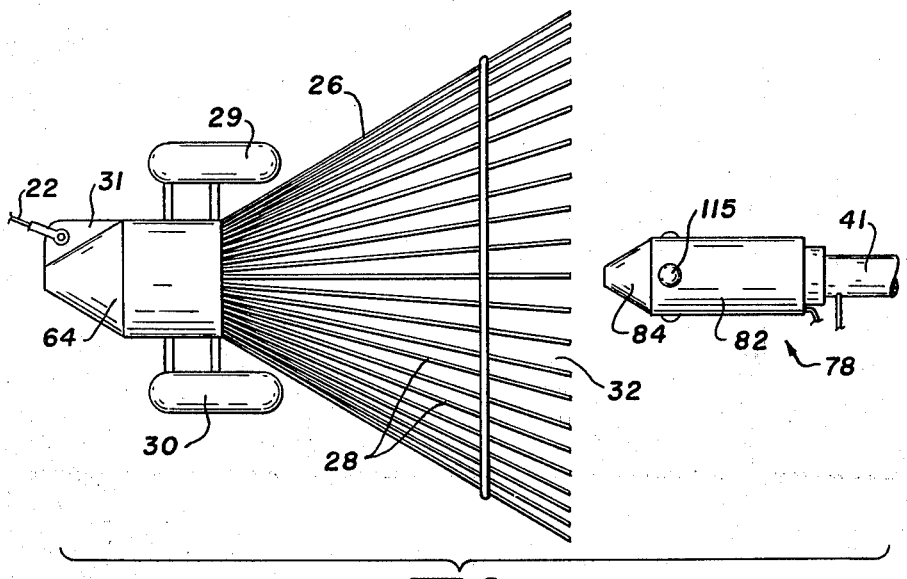
Figure 9:
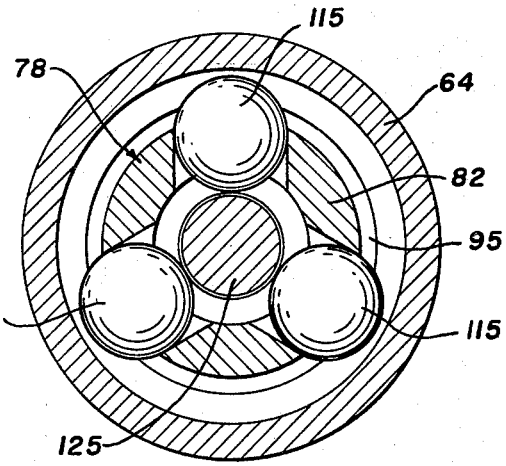

This method and the apparatus according to the present invention will be more clearly understood from the following description and the accompanying drawings, in which FIG. 1 diagrammatically illustrates apparatus according to this invention, including a submersible with one form of probe, FIG. 2 is a side elevation, partly in section, of the apparatus of FIG. 1, FIG. 3 is a side elevation of a submersible with an alternative form of probe in its normal position and just about to engage a drogue, FIG. 4 is a side elevation of the submersible of FIG. 3 showing the probe engaging the drogue and both of these elements in a lifting position, FIG. 5 diagrammatically illustrates an arrangement with the probe on the drogue and a receiver on the submersible, FIG. 6 is an enlarged side elevation of the drogue with its latch element, flotation and ballast tanks, and the latch element of the submersible probe, FIG. 7 is an enlarged longitudinal section through a latching arrangement for the drogue and probe showing the various elements in their normal positions, FIG. 8 is a view similar to FIG. 7, but showing the elements in their latching positions and, FIG. 9 is a cross-section taken on the line 9—9 of FIG. 8.

Referring to FIGS. 1 to 4 of the drawings, 10 diagrammatically illustrates a recovery vessel having a ramp 11 inclined downwardly so that its lower end is below the surface 12 of the water within a well 13 formed in the vessel. A winch 15 is mounted on the deck of the vessel forward of the ramp, and a fairlead roller 16 is positioned at the threshold 17 of the ramp.

A cable 22 is wound on winch 15 and extends downwardly over the ramp and through a tubular fairlead 24, and has a drogue 26 connected to its outer or free end. This drogue can be of any desired shape so that it will have stable towing characteristics with a minimum of turbulence and drag as it is towed through the water. In this example, the drogue is cone-shaped, as shown, and it may have holes 27 therein, as shown in FIGS. 1 to 5 to help reduce turbulence and drag. Alternatively, the drogue may be in the form of a cage-like structure made of steel rods 28 as shown in FIG. 6. In either case, the drogue has flotation and ballast tanks 29 and 30 respectively an attaching or apex end 31 to which cable 22 is secured, and a large open opposite receiving end 32.

A pair of control cables 33 and 34 are connected to fairlead 24 and extend laterally therefrom to winches 35 and 36 upon which the cables are wound, said winches being mounted on the deck of vessel 10 on opposite sides of well 13.

A small self-propelled submersible 40 has a probe 41 mounted thereon and projecting forwardly therefrom. The submersible can be manoeuvered so that the end of probe 41 is moved through the open receiving end 32 of drogue 26 and into the latter. Suitable latching means is provided for releasably connecting the probe to the drogue. Any suitable latching mechanism can be used for this purpose, and a novel latch arrangement which is particularly suitable is hereinafter described.

When it is desired to recover submersible 40, winch 15 is operated to pay out cable 22 while vessel 10 moves forwardly through the water. Sufficient cable is paid out relative to the speed of the vessel and buoyancy of the drogue and cable to maintain drogue 26 at a desired level beneath the surface 12 of the water. Comparatively stable conditions exist at this level regardless of how rough the sea is at its surface.

The submersible 40 is manoeuvered so as to move probe 41 into drogue 26 where the latching means operates to connect the probe to the drogue. If the submersible has a suitably located viewing port, the approach and mating of the probe and drogue can be carried out visually. Suitable light means on the submersible will help this operation. As an alternative, sensors, such as active or passive sonar, can be used to enable the submersible to locate and mate with the drogue. As this type of sensing equipment is well known in the art, it does not require description herein.

As the recovery vessel and the drogue are moving through the water during the manoeuvering of the submersible, the drogue and submersible remain quite stable relative to each other so that the mating operation is easily accomplished.

Once the drogue and probe are latched together, cable 22 is reeled in by winch 15. As this operation continues, the drogue followed by the submersible is drawn over fairlead roller 16 and up on to ramp 11. In actual practice, winch 15 and the ramp may be positioned so that the submersible is drawn up on to the deck of the vessel in order that the submersible can be moved to any desired location therein. As vessels having inclined ramps extending down into the water, such as marine cable laying vessels, are well known, the vessel has been only diagrammatically illustrated herein.

As the submersible is being drawn towards the vessel 10, winches 35 and 36 can be operated to shift fairlead 24 back and forth so as to maintain cable 22 in proper position relative to the vessel. When fairlead 24 is engaged by the drogue, winches 35 and 36 can be allowed to pay out their respective cable in such a way as to keep cable 22 in its proper position relative to ramp 11 and so as to maintain this cable taut at the crucial time when the submersible is being drawn out of the water.

FIG. 3 illustrates submersible 40 with an alternative form of probe 48. This probe is hingedly connected to the submarine at 49 above the center of gravity thereof, and it normally extends in a substantially horizontal position forwardly of the submersible, said probe being releasably held in this position by a clamp 52 mounted on the hull of the submersible.

With this arrangement, the submersible is manoeuvered in the manner described above until the end of probe 48 enters drogue 26. However, with this alternative arrangement, cable 22 may run over the sheaves of a suitable crane, not shown, mounted on the deck of a recovery vessel. In this case, when the drogue and probe are secured together, cable 22 is winched in until the submersible is directly below the crane, at which time probe 48 has swung upwardly into a vertical position, as shown in FIG. 4. Continued winching in of cable 22 raises the submersible in a vertical direction until the latter is clear of the water and can be swung on to the deck of the recovery vessel.

This recovery vessel moves forwardly so as to draw probe 26 through the water as the submersible is being manoeuvered to insert probe 48 into the drogue. Once the connection has been made, the vessel is stopped so that it and the submersible are stationary when the latter is in the position shown in FIG. 4 to allow the submersible to be pulled upwardly through the water with as much control thereof as possible.

Alternatively, the recovery vessel can be stationary with the cable and drogue suspended vertically from a suitable crane. The submersible, with its probe vertical as shown in FIG. 4, can now make a vertical approach to the stationary drogue to make contact and latch in the probe.

In this mode of operation the drogue will be designed to have a suitable negative buoyancy and vertical drag profile so that its sea damped vertical motion will not follow the vertical heaving motion of a pitching rolling recovery ship. This will result in a reasonably steady target for the submersible probe to home in on. When the probe is engaged and latched, the submersible can then be winched vertically upwards. The use of suitable "constant tension winches" will enable this to be carried out without any violent irregular motion of the submersible due to vertical heaving motions of the recovery ship.

FIG. 5 illustrates a probe 52 connected to and projecting rearwardly from drogue 26, and a receiver 53 on the outer end of probe 41 of the submersible 40 of FIGS. 1 and 2. The latching arrangement for this version is the same as that for the elements of FIG. 1, excepting that the mating parts of the latch are reversed in the embodiment of FIG. 5.

It is obvious that probe 52 and receiver 53 can be mounted on the drogue and submersible probe in the manner illustrated in FIG. 5.

When the arrangements of FIGS. 1 to 5 are used to launch the submersible, cable 22 is paid out with the drogue and probe, or drogue probe and submersible probe receiver secured together. This continues until the submersible reaches the desired depth, and then the latch arrangement is unlatched to free the submersible.

FIGS. 6, 7 and 8 illustrate a novel and desirable latch arrangement 60 for drogue 26 and the probe of the submersible. This latch arrangement includes a female member 64 which is adapted to be fixedly secured within the drogue near the apex end thereof. This member 64 has a cylindrical passage 65 therein extending from a conical or outwardly diverging entrance 67 opening out from the end 68 of the member, to a conical cavity 69 at the end of said passage. A passage 71 extends forwardly from cavity 69 through member 64 to its end within drogue 26. An annular groove 73 is formed in the wall of passage 65 and has bevelled walls 74 and 75 therein.

A male member 78 is mounted on the end of the probe of the submersible, such as probe 41. Member 78 includes an elongated tubular head 82 fixedly secured at its inner end 83 to the outer end of probe 41, said head having a conical tip 84 at its opposite outer end. A sleeve 87 is concentrically mounted within tubular head 82 and is fixedly connected thereto by one or more pins 88. Sleeve 87 is formed with an enlargement 89 which forms a shoulder 90 at one end of an annular space 91 between said sleeve and the inner surface of head 82, in which a tubular cocking slide 94 is slidably mounted. Slide 94 has a cylindrical projection 95 of reduced diameter projecting forwardly therefrom, said projection having a bevelled end 97. A plurality of coil springs 100 fit in and project rearwardly from sockets 102 formed in slide 94. These springs at their outer ends bear against shoulder 90 so as to bias the cocking slide forwardly in head 82. A shoulder 105 formed on slide 94 is positioned to abut against a shoulder 106 formed on head 82 to limit the outward movement of the cocking slide.

An annular internal groove 109 is formed in cocking slide 94 substantially midway between its opposite ends. Although not absolutely necessary, this groove is formed with an inclined after wall 110 and a radial forward wall 111.

A plurality of latching balls 115 are provided for head 82, each ball being located in a radial passage 116 in said head adjacent the base of tip 84 thereof. An annular flange 118 projects inwardly of the entrance of each passage 116 to prevent latching ball 115 from moving out of said passage. It will be noted that when ball 115 is seated on the flange, it projects outwardly from head 82, and it is pressed against said flange by the bevelled end 97 of slide 94 under the biasing action of its springs 100. At the same time, the latching ball is completely outside of the inner wall 120 of cocking slide 94, said inner wall being axially aligned with the inner wall 121 of sleeve 87.

A cylindrical latch pin 125 is slidably mounted within sleeve 87, and has a reduced cylindrical projection or nose 126 slidably fitting in an axial passage 127 formed in tip 84 of head 82 and opening outwardly from the forward end of said tip. Latch pin 125 is formed with an annular bevel shoulder 130 which is normally spaced rearwardly just clear of said passages 116 and balls 115 therein. The latch pin is formed with an annular groove 135 which, when said pin is in its normal position, overlies a plurality of circumferentially spaced holes 137 in sleeve 87, in each of which a locking ball 138 is located. Each locking ball projects into groove 135 at this time to lock pin 125 to stationary sleeve 87, cocking slide 94 retaining the balls in this position at this time.

Groove 135 is formed with an after inclined wall 142 and a less inclined forward wall 143. A spring 146 is mounted within latch pin 125 and extends between a wall 147 formed in said pin rearwardly and out of the pin to a stop 149 connected to sleeve 87 just clear of the latch pin.

When member 78, which forms the head or tip of probe 41, is moved by the probe into drogue 26, tip 84 of head 82 moves through the entrance 67 of female member 64 until it enters cavity 69. As tip 84 advances through passage 65 of member 64, latching balls 115 are shifted radially inwardly of head 82, the reduced nose 126 of latch pin 125 making this possible. As the balls are bearing against the beveled end 97 of cocking slide 94, movement of these balls inwardly, shifts the cocking slide rearwardly relative to the latch pin. When the slide is moved in this manner, groove 109 is moved into alignment with locking balls 138 so that the latter are urged by inclined wall 142 under the action of spring 146 against latch pin 125 out of groove 135 and into groove 109 of retracted slide 94 to lock said slide in this position to stationary sleeve 87. This forward movement of the latch pin presses bevel shoulder 130 against balls 115 to force said balls outwardly into groove 73 of female member 64, and this permits pin 125 to move further forwardly under the action of spring 146, locking balls 115 in groove 73, as shown in FIG. 8. This actually locks head 82 and consequently member 78 to member 64. Thus, at this time, probe 41 is positively locked to drogue 26 through latching arrangement 60.

The members 64 and 78 can be released from each other and the latching arrangement reset merely by inserting a blunt instrument through passage 71 of member 64 and into passage 127 within the tip 84 of head 82 and against the end of nose 126 of latching pin 125. Movement of the latching pin rearwardly shifts the reduced nose 126 thereof into line with balls 115, thereby freeing said balls to move radially inwardly. Continued rearward movement of pin 125 causes the entire member 78 to move with it. Balls 115 are moved inwardly by the sloping side 74 of groove 73. At the same time, groove 135 of pin 125 is moved into alignment with balls 138. As cocking slide 94 is biased forwardly by springs 100, the bevel wall 110 of groove 109 in the cocking slide forces balls 138 into groove 135 of the latch pin to lock the latter to stationary sleeve 87. Slide 94 is now free to slide forward under axial load of spring 146 and its bevelled end 97 forces balls 115 radially outwards to make contact with flange 118 in radial passage 116. Thus, the apparatus is cocked and ready for another latching operation.

The apparatus can be released and reset from within submersible 40. This can be accomplished by a rod 155 connected at one end to latch pin 125 at 156 and at its opposite end to a piston 158 slidably mounted in a cylinder 159 mounted within and connected to the rearward end 83 of head 82 of member 78. Fluid passages 162 and 163 open into opposite ends of cylinder 159. The piston is moved back and forth in the cylinder by fluid, such as air or liquid, directed into either end of the cylinder through tubes 165 and 166 which extend from passages 162 and 163 into the submersible where they are connected to a suitable fluid source and control system. Fluid directed through tube 165 into the cylinder 159 moves piston 158 and, consequently, latch pin 125 rearwardly from the position shown in FIG. 6 to cock the mechanism.

Alternately, passage 162 can open out to the sea so that piston 158 is exposed to sea pressure, while tube 166 extends into the submersible. If this tube 166 is hydraulically sealed, rising sea water pressure associated with increased depth below the surface will have no effect when the piston is in its forward position, the submersible being connected to the drogue at this time. However below a certain depth, release of this hydraulic lock will allow the ambient sea pressure to drive piston 158 rearwardly and so release the catch and allow the probe to separate from the drogue.

I claim:

1. A method of recovering a small self-propelled submersible in water by means of a probe element releasably latchable with a drogue element, one of said elements being connected to the end of a cable which extends downwardly and horizontally to said one element and the other of said elements being connected to the submersible, comprising moving that element connected to the cable horizontally through the water at such a speed that the velocity, weight and length of the downwardly and horizontally extending cable maintain the latter element at a level below the surface of the water where comparatively stable conditions exist and where the movement of the latter element is essentially independent of vertical movements at the surface of the water and the latter element presents a rearwardly facing receiving means as it is moving, moving the other of said elements horizontally to said first element at a little greater speed and in line with said first element until latching together of said elements occurs upon said horizontal movement, to connect the submersible to the cable at said level, the latching resulting from said horizontal movements being effective to prevent further relative motion between the probe and drogue.

2. A method as claimed in claim 1 in which said cable is towed by a vessel having a ramp extending down into the water and along which the cable extends, and when said cable is drawn in the submersible is drawn to the ramp, and then drawing said submersible up said ramp.

3. A method as claims in claim 2 including guiding the cable as it is drawn in to keep the cable and the submersible moving up the ramp in a predetermined line while keeping said cable taut.

4. A method as claimed in claim 1, said element connected to the cable being the drogue, and the element connected to the submersible being the probe.

5. A method as claimed in claim 4, wherein moving the drogue through the water comrises towing it from a vessel to which the upper end of the cable is connected.

6. A method as claimed in claim 5, and including drawing in the cable after latching to move the submersible to a desired position for removal from the water.

7. A method of recovering a small self-propelled submersible from the water in which the submersible operates, comprising towing a drogue horizontally through the water by a cable extending downwardly and horizontally rearwardly from a moving recovery vessel to the drogue, controlling the speed of the vessel and the length of the cable so that the velocity, weight and length of the downwardly and horizontally extending cable maintain the drogue at a level below the surface of the water where comparatively stable conditions exist and where movements of the drogue are essentially independent of the vertical movements of the recovery vessel due to wave motion at the surface, said drogue having latching means therein which face rearwardly as the drogue is being towed horizontally, manoeuvering a submersible having a probe thereon horizontally at a little greater speed than the drogue and in horizontal alignment therewith to insert the probe horizontally into the drogue until the probe is latched to the drogue upon said horizontal movement, such that said latching resulting from horizontal movements is effective to prevent further relative motion between the probe and drogue, and drawing in the cable to move the submersible out of the water.

8. A method as claimed in claim 7 including keeping the recovery vessel moving while the cable is being drawn in.

9. A method as claimed in claim 8, including drawing the submersible up a ramp on the recovery vessel by drawing in the cable.

10. A method as claimed in claim 9, including guiding the cable as it is drawn in to keep the cable and the submersible moving up the ramp in a predetermined line while keeping said cable taut.

11. Apparatus for launching and recovering a small self-propelled submersible from the water in which the submersible operates comprising a drogue having an attaching end and a rearwardly facing receiving end, a cable connected at its free end to said attaching end and extending downwardly and rearwardly from a recovery vessel to the drogue, the drogue constructed of a shape with an apex and a rearwardly increasing outer cross-section to provide stable towing characteristics, the length of the cable and the buoyancy and shape of the drogue and cable constituting means for maintaining the drogue at a desired level below the surface of the water and for keeping the drogue independent of the vertical movements of the surface vessel due to wave movements at the surface of the water as the drogue moves horizontally through the water at said level, a horizontally extending prove connected to the submersible, and a releasable latch means having cooperating parts within the drogue and on the probe for inserting the probe horizontally into the drogue to releasably connect the submersible to the dorgue and the cable such that relative motion between the probe and drogue are prevented.

12. Apparatus as claimed in claim 11 in which said drogue is substantially cone-shaped, said drogue having an apex at one end and a large open opposite end forming respectively said attaching and receiving ends.

13. Apparatus as claimed in claim 11 in which the probe extends forwardly from the submersible.

14. Apparatus as claimed in claim 11 in which the probe is hingedly connected at an inner end thereof to the submersible over the center of gravity of the latter, and including means releasably retaining the probe in a position extending forwardly of the submersible, said probe when released being swingable into a substantially vertical position.

15. Apparatus as claimed in claim 11 in which said releasable latch means comprises a female member mounted in the drogue, a male member mounted on the probe, and a latch on the male member which on movement of said male member into the female member releasably latch said members together.

16. Apparatus as claimed in claim 11 in which said releasable latch means comprises a female member mounted in the drogue and having a passage extending longitudinally thereof, an annular groove formed within said female member and opening into said passage, a male member mounted on the probe, latching balls mounted in the male member, and means resiliently urging said balls outwardly to a limited degree in a radial direction, whereby movement of the male member into the female member first depresses said balls which are then urged into said annular groove upon movement into the line therewith to latch said members together.

17. Apparatus as claimed in claim 16 including means releasably locking the balls in said annular groove.

18. Apparatus according to claim 11, including floatation and ballast tanks on the drogue to maintain the latter at said desired level below the surface of the water.

19. Apparatus for launching and recovering a small self-propelled submersible from the water in which the submersible operates comprising a drogue, a cable connected at its free end to the drogue and extending downwardly and rearwardly from a recovery vessel to the drogue, the drogue constructed of a shape with an apex and a rearwardly increasing outer cross-section to provide stable towing characteristics, the length of a cable and the buoyancy of the drogue and cable constituting means for maintaining the drogue at a desired level below the surface of the water and for keeping the drogue independent of the vertical movement of the surface vessel due to wave movements at the surface of the water as the drogue moves horizontally through the water at said level, a horizontally extending probe connected to and projecting outwardly and rearwardly from the drogue, a horizontally extending receiver connected to the submersible and a releasable latch means having co-operating parts within the receiver and on the probe for inserting the probe horizontally into the receiver to releasably connect the submersible to the drogue and the cable such that relative motion between the probe and drogue are prevented.

* * * * *